US005540500A

United States Patent [19]

Tanaka

[11] Patent Number: 5,540,500

[45] Date of Patent: Jul. 30, 1996

[54] COMPRESSIVE SEALED BAG FOR COMPRESSIBLE ARTICLES SUCH AS CLOTHING AND THE SAME

[75] Inventor: Mikio Tanaka, Nara, Japan

[73] Assignees: Nichimen Corporation; Kashiwara Seitai Co., Ltd., both of Osaka; Kaken Kogyo Co., Ltd., Tokyo, all of Japan

[21] Appl. No.: 401,407

[22] Filed: Mar. 9, 1995

[30] Foreign Application Priority Data

Apr. 25, 1994 [JP] Japan ..... 6-005696 U

[51] Int. Cl.[6] ..... B65D 33/01

[52] U.S. Cl. ..... 383/43; 383/38; 383/63; 383/100

[58] Field of Search ..... 383/41, 44, 45, 383/63, 100, 101, 38, 3

[56] References Cited

U.S. PATENT DOCUMENTS

| | | | |
|---|---|---|---|
| 5,080,155 | 1/1992 | Crozier | 383/63 X |
| 5,142,970 | 9/1992 | ErkenBrack | 383/100 X |
| 5,240,112 | 8/1993 | Newburger | 383/63 X |

FOREIGN PATENT DOCUMENTS

| | | | |
|---|---|---|---|
| 0240451 | 9/1989 | Japan | 383/44 |
| 0139351 | 5/1990 | Japan | 383/63 |
| 02112355 | 9/1991 | Japan | 383/63 |
| 405305953 | 11/1993 | Japan | 383/100 |
| 406099991 | 4/1994 | Japan | 383/63 |
| 406227551 | 8/1994 | Japan | 383/100 |

*Primary Examiner*—Jes F. Pascua
*Attorney, Agent, or Firm*—Koda and Androlia

[57] ABSTRACT

A compressive sealed bag for compressible articles such as clothing comprising a sealed bag body of a plastic film having sealing fasteners formed at an opening portion of the bag body and a check valve formed with a flat pipe of a plastic film and provided at any marginal portions of the bag body other than the opening portion and having a base end inserted into the bag body and a tip end projecting to the outside for discharging the air from the bag body, said sealing fastener being provided at least two positions at the opening portion of the bag body, said tip end of the check valve provided at the marginal portion of the bag body being enveloped in a covering envelope of a plastic film having a discharge outlet of the air.

3 Claims, 5 Drawing Sheets

COMPRESSIVE SEALED BAG FOR COMPRESSIBLE ARTICLES SUCH AS CLOTHING AND THE SAME

BACKGROUND OF THE INVENTION

1. Field of the Invention

This invention relates to a compressive sealed bag for compressible articles such as clothing and the same and more particularly to an improvement of a compressive sealed bag for compressible articles such as clothing and so forth which can maintain compressed and sealed conditions of compressible articles in a steady manner and for a long period of time, which can compress bulky articles to thin condition so that compressible bulky articles can be stored and carried in a small space. Spare clothes such as underwears can be carried in said compressive bag under a compressed and sealed condition during travelling, so that a bad smell of soiled clothes does not spread outside and washed or drenched clothes do not spoil other clothes.

2. Prior Arts

Heretofore spare clothing such as underwears to be changed during travelling have been carried in a travelling bag as they are or in a packed manner in a vinyl bag or in a packed and sealed manner in a vinyl bag having a sealing fastener at an opening portion.

Disclosed in the Japanese patent application laid open under No. 5-26886 is a compressive sealed bag for clothing comprising a sealed bag body of a plastic film having a sealing fastener formed at an opening portion and a check valve formed with a flat pipe of a plastic film and provided at any marginal portion of the bag body other than the opening portion by a bonding means and having a base end inserted into the bag body and a tip end projecting to the outside for discharging the air in the bag body, at least outer surfaces of said base end being bonded to the inner surfaces of the bag body.

Carrying soiled underwears, socks or other clothing in a travelling bag as they are or in a packed manner in a vinyl bag, a bad smell spreads in a travelling bag and adheres to other contents and washed or drenched clothing spoil other contents, because there is no sealing means. In case of a vinyl bag having a sealing fastener, the above problems are eliminated but there is still such a problem that clothing can not be carried in a compressed compact manner as is the same to the above two carrying manner, so that it is very inconvenient to carry a bulky clothing in a travelling bag.

In case of a compressive sealed bag for clothing, there is such a great merit that clothing can be carried in a travelling bag in a compact and compressed condition. But as only one sealing fastener is formed at an opening portion and a tip end of the check valve projects to the outside of the bag body, a sealing effect of the bag was not sufficient. Consequently with the lapse of time air enters into the bag little by little and a compression power for clothing deteriorates gradually. Besides a tip end of the check valve are liable to suffer damage so that valve action is apt to be injured.

SUMMARY OF THE INVENTION

It is therefore an object of the present invention to provide a compressive sealed bag for compressible articles such as clothing and the same which can easily and securely compress and seal the compressible articles and maintain the sealing effect in a good condition.

In order to achieve the above object, the present invention has provided a compressive sealed bag for compressible articles such as clothing comprising a sealed bag body of a plastic film having a sealing fastener formed at an opening portion and a check valve formed with a flat pipe of a plastic film and provided at any marginal portion of the bag body other than the opening portion by a bonding means and having a base end inserted into the bag body and a tip end projecting to the outside for discharging the air in the bag body, at least outer surfaces of said base end being bonded to the inner surfaces of the bag body, said sealing fastener being provided at least two positions at the opening portion of the bag body, said tip end of the check valve provided at the marginal portion of the bag body being enveloped in a covering envelope of a plastic film which is formed continuously from the marginal portion and a discharge outlet of the air being provided at said envelope.

Said covering envelope may be formed continuously throughout the whole width of the marginal portion or only at the marginal portion where the check valve is provided.

Said sealing fastener may be composed of a male fastener member provided with a flat base of a plastic tape and a linear protrusion having an enlarged head portion and a female fastener member provided with a linear groove which receives tightly the above enlarged head portion detachably.

According to the compressive sealed bag provided by the present invention, compressible articles such as clothing can be contained in a tight sealing condition when the opening portion receiving the contents is tightly closed by a plurality of sealing fasteners as the inside of the bag body only connects to the outside through the check valve so as to discharge the air in the bag body. Consecutive pressing of all over the bag body so as to press the compressible articles contained therein makes the air contained in the bag body discharge outside through the check valve and the discharge outlet provided at the covering envelope. Consequently the compressible articles are compressed to a compact and thin condition while maintaining the sealing condition.

The outer surfaces of the base end of the check valve inserted into the bag body are bonded to the inner surfaces of the bag body and not free from the bag body, so that the pressure added to the bag body and inflating the marginal portion where the check valve is provided also inflates a discharge outlet formed at the base end of the check valve. As a result, the air in the bag body is discharged outside smoothly and without fail and consequently the compression of the compressible articles is remarkably improved.

The tip end of the check valve is covered and protected by the covering envelope so that no damage or breakage occurs due to an abrasive contact with something else. Accordingly the function of the check valve is maintained well for a long period of time. Furthermore the opening portion of the bag body is securely sealed by a plurality of sealing fasteners, and the air inflow to the inside of the bag body is prevented without fail.

DETAILED DESCRIPTION OF THE INVENTION

Figure 1:
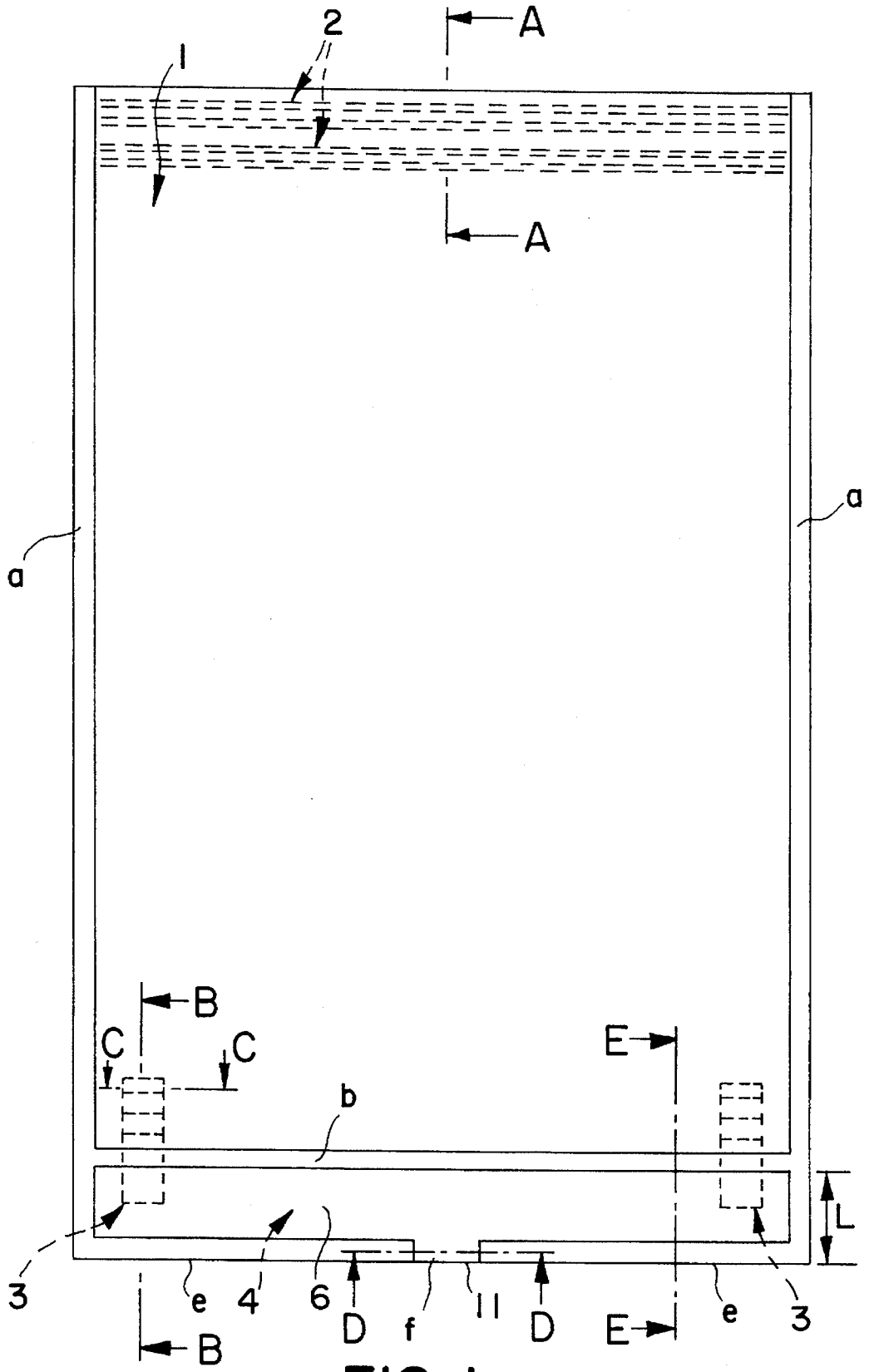
FIG. 1 is a front view showing one embodiment of the compressive sealed bag according to the present invention.
Figure 2:
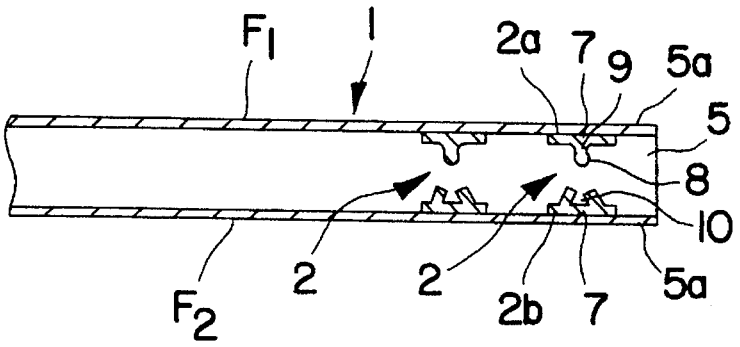
FIG. 2 is an enlarged cross sectional view along the line A—A in FIG. 1.

The present invention will now be described referring to the drawings which illustrate some embodiments.

One embodiment of a compressive sealed bag for compressible articles such as clothing and the same comprises a sealed bag body 1 of an antibacterial plastic film having a pliability and heat bonding property, two sealing fasteners 2,2 formed at the inner faces of an opening portion of the bag body 1, a check valve 3 formed with a flat pipe of a plastic film having a higher pliability and heat bonding property provided at any marginal portion of the bag body other than the opening portion by heat bonding and having a base end inserted into the bag body and a tip end projecting to the outside for discharging the air in the bag body and a covering envelope 4 of the same plastic film as used for the bag body 1.

The bag body 1 is composed of two sheets of rectangular transparent antibacterial plastic film $F_1$, $F_2$ overlaid each other. One margin is remained open for forming an opening portion 5 and two side margins a,a extending in the lengthwise direction are heat bonded. An opposite margin b to the opening portion 5 is formed by heat bonding the films at an inner position with a space L whereby a rectangular free end portion 6 having a dimension of L is provided along the margin b. The above three margins a,a,b are bonded at the same time when the check valve is heat bonded.

The sealing fasteners 2,2 are composed of a male fastener member **2*a* provided with a flat base 7 of a plastic tape having a pliability and elasticity and a linear protrusion 9 having an enlarged head portion 8 and a female fastener member 2*b* provided with a flat base 7 of the same plastic tape as used for the male fastener member 2*a* and a linear groove 10 which is formed on the surface of the flat base 7 and receives tightly the above enlarged head portion 8 of the linear protrusion 9 in a detachable manner. The male and female fastener members 2*a*,2*b* are provided at the inner faces of the opening portion 5 of the bag body 1 by bonding the flat bases 7, 7 to the inner faces at a little inner position spaced from the opening end with the linear protrusion 9 and the linear groove 10 faced each other. The reference numeral 5*a* shows a remnant which serves as a pinch portion for easy fastening and unfastening of the fastener members 2*a*,2*b***.

The check valve 3 comprises two rectangular narrow plastic films $F_3$, $F_4$ of the same dimension and a valve body **3*a* formed by a folded plastic film $F_5$ having the same dimension with the plastic films $F_3$, $F_4$ and disposed between the plastic films $F_3$, $F_4$ at about a center portion thereof. Both side edges of the plastic films $F_3$, $F_4$ are heat bonded together with side edges of the valve body 3*a*. A folded portion 3*b* of the folded plastic film $F_5$ is disposed so that an outer surface positions at the base end side. As the check valve 3 of a flat pipe form completely performs a valve action without the valve body 3*a*, the valve body 3*a* is not necessarily required. Accordingly a detailed description is omitted. In brief, the air is prevented from flowing into the bag body 1 by a dead inner surface of the folded portion 3*b*, while the air is discharged from the bag body 1 to the outside through an aperture formed between the inner surfaces of the check valve and the outer surfaces of the valve body 3*a***.

Figure 3:
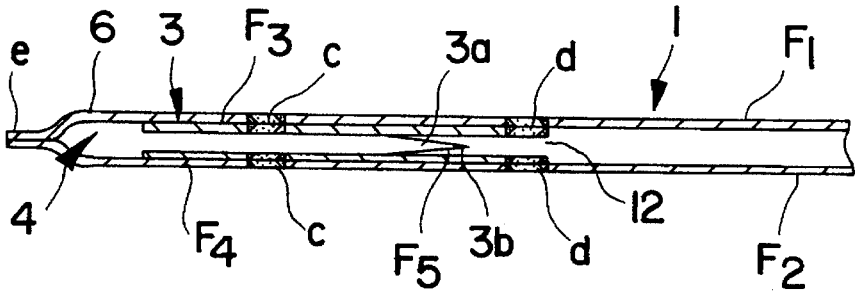
FIG. 3 is an enlarged cross sectional view along the line B—B in FIG. 1.
Figure 4:
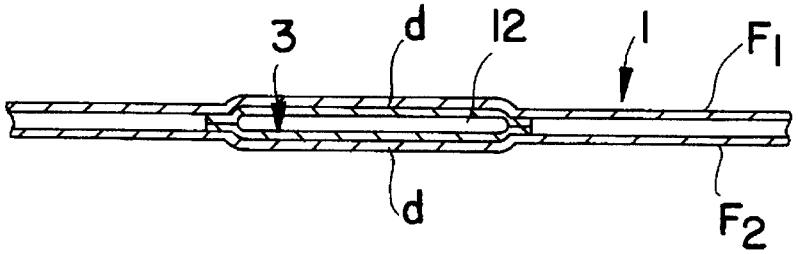
FIG. 4 is an enlarged cross sectional view along the line C—C in FIG. 1.
Figure 5:
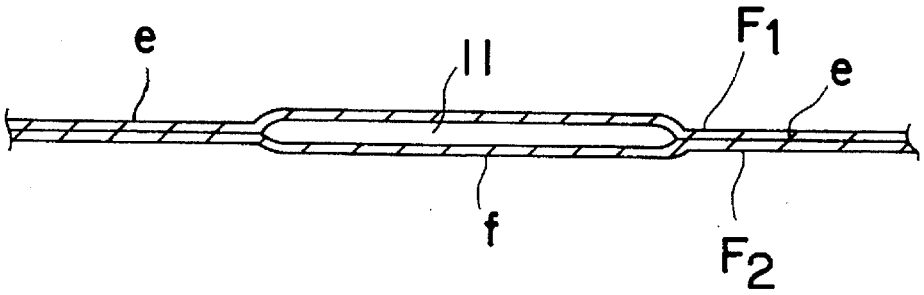
FIG. 5 is an enlarged cross sectional view along the line D—D in FIG. 1.
Figure 6:
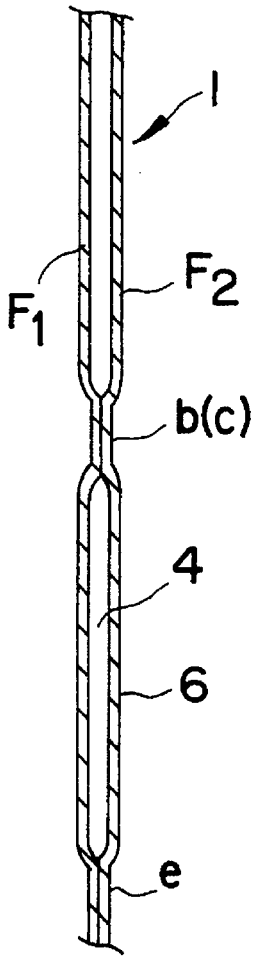
FIG. 6 is an enlarged cross sectional view along the line E—E in FIG. 1.

As shown in FIG. 1 and FIG. 3, two check valves 3 are provided at the vicinity of the corner portions of the bag body 1 with the base end inserted into the bag body 1 through the inner margin b and the tip end projecting to the outside and covered by the covering envelope 4. The outer surfaces of the check valves 3, 3 are heat bonded, as shown by c, c in FIG. 3, to the inner surfaces of the inner margin b at the same time when the margins a,a,b of the bag body 1 are heat bonded. In this embodiment, the outer surfaces of the base end are also heat bonded to the inner surfaces of the bag body 1 as shown by d, d in FIG. 3.

The covering envelope 4 is formed by heat bonding the free margin e of the free end portion 6 along the whole length of the inner margin b. Said heat bonding of the free margin e is conducted at the same time when the margins a,a,b are heat bonded. The discharge outlet 11 is formed at the covering envelope 4 by remaining an unbonded portion f at the center of the margin e when the free margin e is heat bonded.

Thus constructed is the compressive sealed bag for compressible articles such as clothing and the same comprising two parallel sealing fasteners 2,2 provided at the opening portion 5 of the bag body 1, two check valves 3,3 for discharging the air in the bag body 1 which are provided at the inner margin opposed to the opening portion and positioned at the corner portions of the bag body 1 and the covering envelope 4, for covering the tip end projecting from the margin, provided along the inner margin and provided with the discharge outlet 11 of the air in the bag body. Reference numeral 12 in FIG. 3 shows the discharge outlet of the air provided at the base end of the check valve 3.

Figure 7:
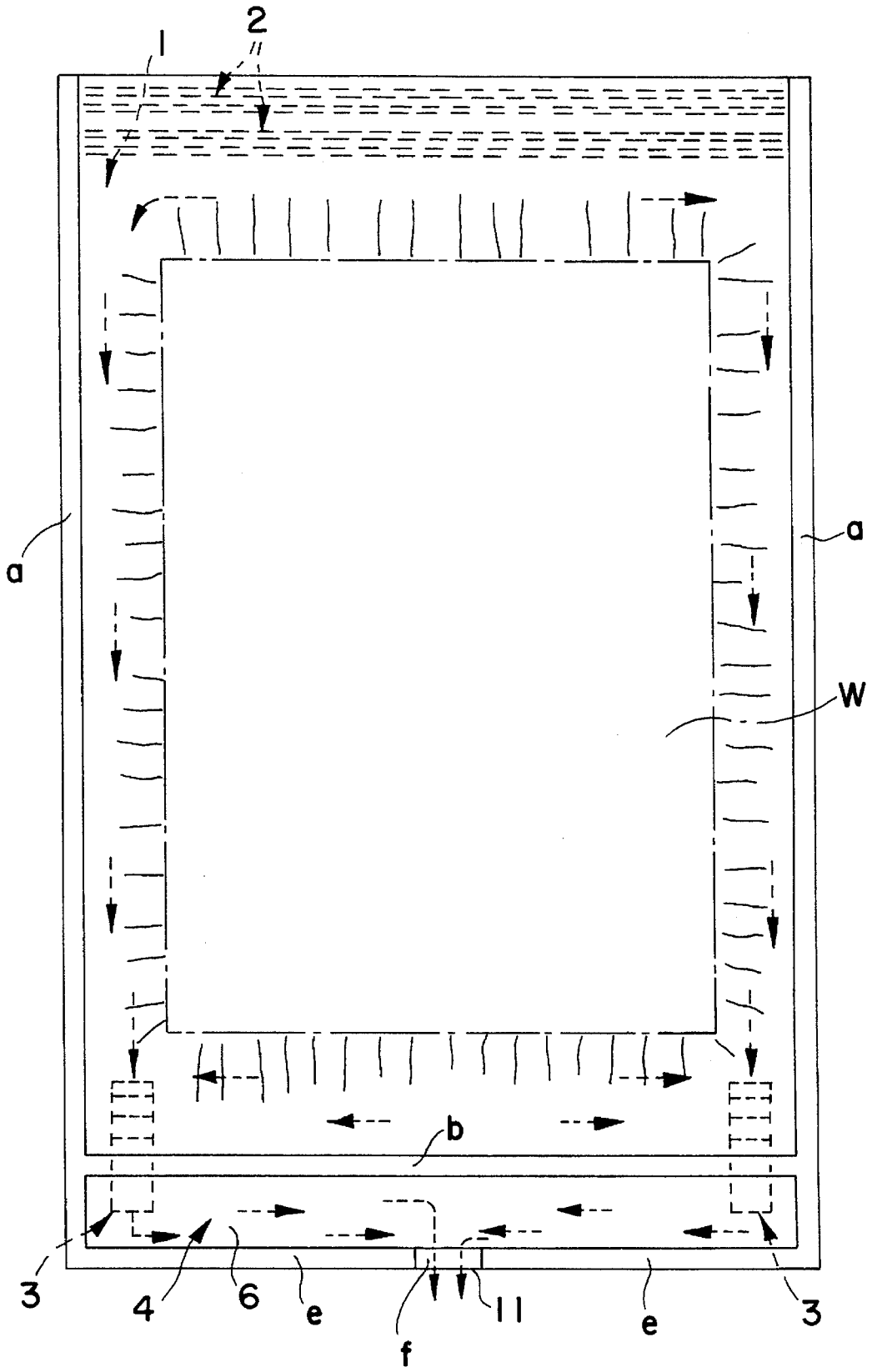
FIG. 7 is a schematic front view illustrating the compressive sealed bag wherein a compressible article such as clothing is contained in a compressed and sealed condition.

The compressible articles W such as clothing are enclosed in the bag body 1 through the opening portion 5 and contained in a sealed condition by fastening the two sealing fasteners 2,2 by engaging tightly the enlarged head portion 8 of the linear protrusion 9 of the male fastener member **2*a* in the linear groove 10 of the female fastener member 2*b*. Consecutively pressing of all over the bag body 1 so as to press the compressible articles contained therein makes the air contained in the bag body discharge outside smoothly through the check valve 3,3 which is provided at the corner portions, as shown in FIG. 7, and the discharge outlet 11 provided at the covering envelope 4**. As a result, the compressible articles are compressed to a compact and thin condition while maintaining the sealing condition which prevents the air from flowing into the bag body.

The tip end of the check valve 3 is enveloped by the covering envelope 4 not so as to be exposed to the outside, whereby the effect of the check valve to prevent the air from flowing into the bag body 1 is remarkably improved. No damage or breakage of the tip end occurs due to an abrasive contact with something else and so the function of the check valve is maintained well and the compressive sealed condition is kept well for a long period of time.

The outer surfaces of the base end of the check valves 3 are bonded to the inner surfaces of the bag body as shown by d,d, so that the pressure added to the bag body 1 and inflating the marginal portion where the check valves are provided also inflates the discharge outlets 12 of the check valves 3. As a result, the air in the bag body 1 is discharged outside smoothly and without fail and consequently the compressive and sealed condition of the compressive articles enclosed is remarkably improved.

In this embodiment, the bag body 1 is formed with antibacterial plastic films $F_1$, $F_2$, so that the contents such as sweat-stained and dirty underwears are prevented from smelling bad and gathering mould and kept hygienic.

Figure 8:
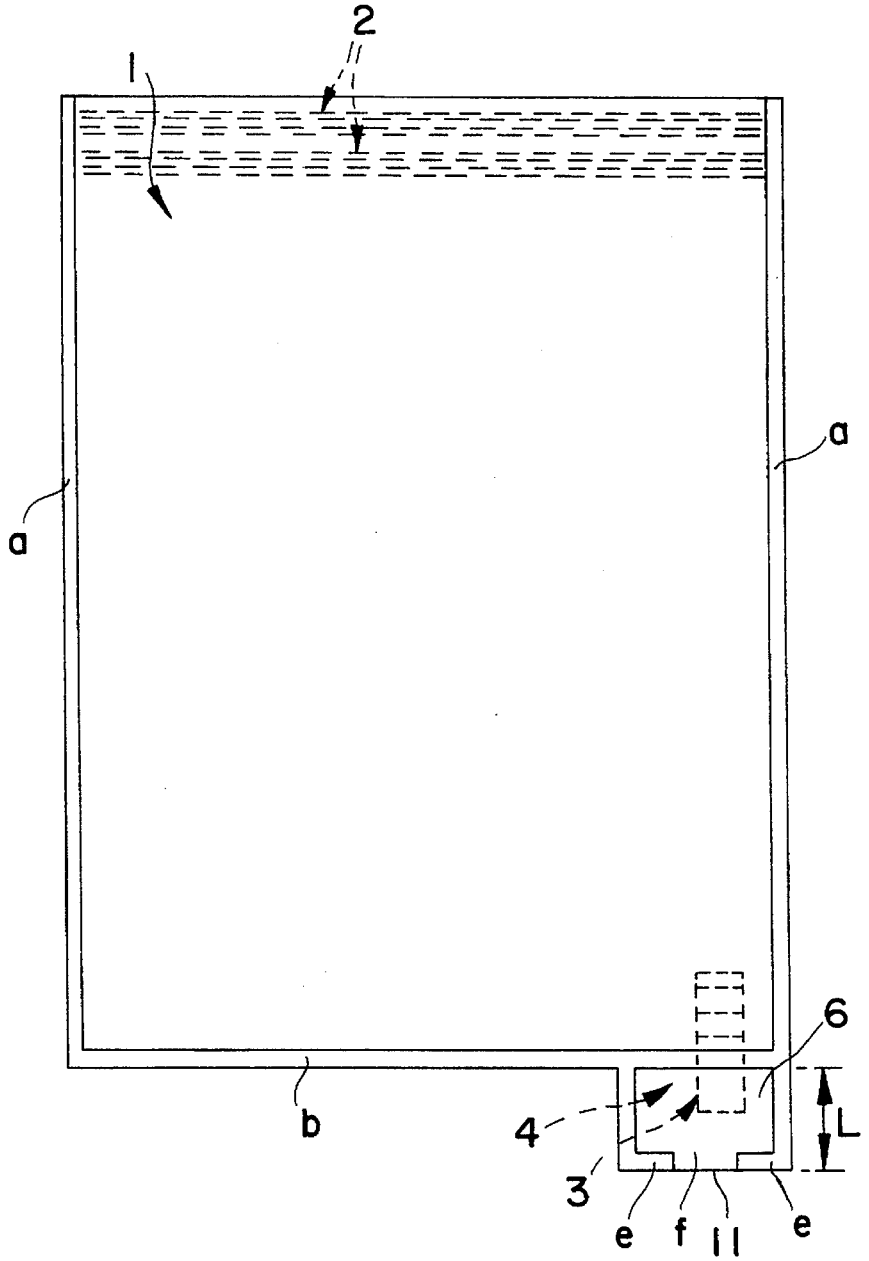
FIG. 8 is a front view showing another embodiment of the compressive sealed bag according to the present invention.

Shown in FIG. 8 is another embodiment of the compressive sealed bag which differs from the above embodiment in the following points. Namely, the bag body 1 is of a small size having one check valve 2 provided at one corner portion of the bag body 1 and the covering envelope 4 is formed continuously from a part of the marginal portion at which the check valve is provided. Other constructions are the same with those of the above embodiment and same reference numerals are affixed to the same portions with the above embodiment.

The compressive sealed bag in this embodiment is of a small size, so that it is preferred to be employed for a carrying bag during travelling to contain underwears, socks etc. either before or after wearing. In addition to the smallness of the bag body, as the covering envelope 4 is also small, the used amount of plastic films can be diminished compared with the above embodiment.

Figure 9:
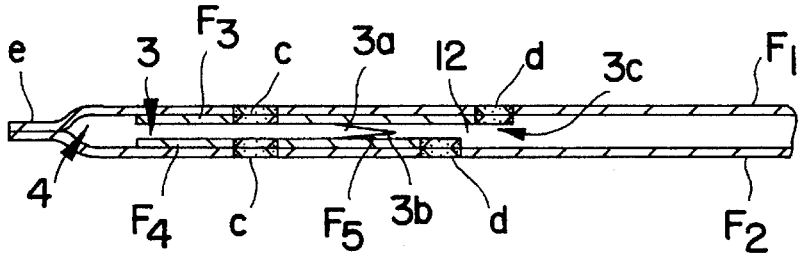
FIG. 9 is an enlarged cross sectional view of a still another embodiment of the compressive sealed bag according to the present invention which illustrates the similar portion as shown in FIG. 3.

Shown in FIG. 9 is further embodiment of the compressive sealed bag which differs from the above two embodiments in the construction of the check valve 3. One of the two plastic films $F_3$, $F_4$ of a rectangular narrow tape which forms the check valve 3, i.e. the plastic film $F_4$ is formed a little shorter than the plastic film $F_4$ and one side of the check valve 3 is shorter than the other side. Consequently a projection tip 3*c* is formed at the base end of the check valve 3. The discharging outlet 12 of the air is provided at a stepped portion, which enhances the disc hargeability of the air. Other constructions are the same with those of the above embodiments and same reference numerals are affixed to the same portions with the above embodiments.

Preferred embodiments of the present invention have been discussed and illustrated only by way of example. The present invention is therefore not limited to these embodiments. All modifications and variations of the invention should be included in the invention without departing from the scope of the attached claims. For example, the number and the position of the check valve 3 and the number and the position of discharging outlet 11 provided at the covering envelope 4 may be selected properly.

As apparent from the above description, the present invention can provide a highly improved compressive sealed bag having the following superior effects.

The compressive and sealed condition of the compressible articles such as clothing can be maintained for a long period of time without fail and the bulky articles can be compressed to a compact and thin condition. As a result, the compressible articles can be contained, preserved and transferred in a small space.

The opening portion of the bag body can be sealed without fail by a plurality of sealing fasteners and the tip end of the check valve is enveloped by the covering envelope whereby the prevention effect of the air inflow can be improved, so that the compressive and sealed condition of the compressible articles can be maintained well without fail.

The tip end of the check valve is enveloped by the covering envelope, so that the tip end is free from the damage or breakage caused by the abrasive contact with something else and so the function of the check valve is never spoiled.

The base end of the check valve inserted into the bag body is fixed to and not free from the inner surface of the bag body, so that the dischargeability of the air contained in the bag body is enhanced.

We claim:

1. A compressive sealed bag for compressible articles comprising a sealed bag body having a marginal portion and an opening portion provided in said marginal portion, said sealed bag body being made of a plastic film having a sealing fastener formed at said opening portion and a check valve of a flat pipe form and formed by plastic film is provided at any marginal portion of the bag body other than the opening portion by a bonding means and having a base end inserted into the bag body and a tip end projecting to an outside for discharging air in the bag body, at least outer surfaces of said base end being bonded to inner surfaces of the bag body, said tip end of the check valve provided at the marginal portion of the bag body being enveloped in a covering envelope of a plastic film which is formed continuously from the marginal portion and a discharge outlet of the air being provided at said envelope.

2. A compressive sealed bag for compressible articles claimed in claim 1, wherein said covering envelope for enveloping said tip end of the check valve is formed continuously throughout the whole width of the marginal portion of the bag body.

3. A compressive sealed bag for compressible articles claimed in claim 1, wherein said sealing fastener is composed a male fastener member provided with a flat base of a plastic tape and a linear protrusion having an enlarged head portion and a female fastener member provided with a linear groove which detachably receives the enlarged head portion.

* * * * *